US006644375B2

(12) United States Patent
Palmer

(10) Patent No.: US 6,644,375 B2
(45) Date of Patent: Nov. 11, 2003

(54) CORDLESS BLIND BRAKE

(75) Inventor: Roger C. Palmer, Greensboro, NC (US)

(73) Assignee: Newell Window Furnishings, High Point, NC (US)

( * ) Notice: Subject to any disclaimer, the term of this patent is extended or adjusted under 35 U.S.C. 154(b) by 24 days.

(21) Appl. No.: 09/756,942

(22) Filed: Jan. 9, 2001

(65) Prior Publication Data

US 2002/0088562 A1 Jul. 11, 2002

(51) Int. Cl.[7] ..... E06B 3/322

(52) U.S. Cl. ..... 160/170 R; 160/84.04

(58) Field of Search ..... 160/170 R, 171 R, 160/172 R, 84.05, 192, 84.04; 185/37, 39, 45

(56) References Cited

U.S. PATENT DOCUMENTS

| | | | |
|---|---|---|---|
| 13,251 | A | 7/1855 | Bixler |
| 322,732 | A | 7/1885 | Lang |
| 794,937 | A | 7/1905 | Hopkins |
| 842,401 | A | 1/1907 | Goodill |
| 927,090 | A | 7/1909 | Anderson |
| 948,239 | A | 2/1910 | McManus |
| 1,215,985 | A | 2/1917 | Plate |
| 1,636,601 | A | 7/1927 | Givens |
| 1,669,255 | A | 5/1928 | Landry |
| 1,721,501 | A | 7/1929 | McKee |
| 1,731,124 | A | 10/1929 | Carper |
| 1,789,655 | A | 1/1931 | Toshi-Ko Iwata |
| 1,804,811 | A | 5/1931 | Rosel |
| 1,951,659 | A | 3/1934 | Kesner |
| 2,037,393 | A | 4/1936 | Roberts |
| 2,048,518 | A | 8/1936 | Schier |
| 2,049,518 | A | 8/1936 | Schier |
| 2,053,356 | A | 9/1936 | Wiener |
| 2,110,983 | A | 3/1938 | Carver |
| 2,129,606 | A | 9/1938 | Nisenson |
| 2,132,991 | A | 10/1938 | Mintz |
| 2,172,657 | A | 9/1939 | Haase |
| 2,175,549 | A | 10/1939 | Nardulli et al. |
| 2,175,977 | A | 10/1939 | Stuber et al. |
| 2,250,106 | A | 7/1941 | Lorentzen |
| 2,260,101 | A | 10/1941 | De Falco |
| 2,266,160 | A | 12/1941 | Burns |
| 2,276,716 | A | 3/1942 | Cardona |
| 2,324,536 | A | 7/1943 | Pratt |

(List continued on next page.)

FOREIGN PATENT DOCUMENTS

| | | |
|---|---|---|
| DE | 40 03 218 | 8/1956 |
| DE | 85 17 182 U1 | 9/1985 |
| DE | 40 03 218 A1 | 8/1991 |
| EA | 1 039 092 A2 | 9/2000 |
| EP | 1 039 092 | 9/2000 |
| FR | 883 709 | 7/1943 |
| FR | 2 337 809 | 8/1977 |
| GB | 2 262 324 A | 6/1993 |

OTHER PUBLICATIONS

F.A. Votta, The Theory and Design of Long–Deflection Constant–Force Spring Elements, Transactions of the Asme, May 1952, pp. 439–450.

European Search Report—European Application No. 02 00 0180, International Filing Date: Jan. 9, 2002, Search Report Completed Feb. 19, 2002 in Munich by Examiner P. Kofoed.

*Primary Examiner*—David M. Purol

(74) *Attorney, Agent, or Firm*—Marshall, Gerstein & Borun LLP

(57) ABSTRACT

A window blind comprising a head rail, a bottom rail and a window covering extending between and operatively connected to the head rail and bottom rail. At least one lift cord extends between the bottom rail and the head rail. A spring motor operatively coupled to the lift cord applies an upward force on the bottom rail toward the head rail. A one way brake prohibits the bottom rail from moving toward the head rail but permits the bottom rail to be moved away from the head rail by an operator.

42 Claims, 4 Drawing Sheets

U.S. PATENT DOCUMENTS 2,325,992 A 8/1943 Wirthman
2,350,094 A 5/1944 Butts
2,390,826 A 12/1945 Cohn
2,410,549 A 11/1946 Olson
2,420,301 A 5/1947 Cusumano
2,509,033 A 5/1950 Carver
2,520,629 A 8/1950 Esposito
2,535,751 A 12/1950 Nardulli
2,598,887 A 6/1952 Burns
2,609,193 A 9/1952 Foster
2,687,769 A 8/1954 Gershuny
2,732,010 A 1/1956 Griesser
2,824,608 A 2/1958 Etten
2,874,612 A 2/1959 Luboshez
3,141,497 A 7/1964 Griesser
3,194,343 A 7/1965 Sindlinger
3,358,612 A 12/1967 Bleuer
3,371,700 A 3/1968 Romano
3,485,285 A 12/1969 Anderle
3,487,875 A 1/1970 Shukat et al.
3,727,665 A 4/1973 Debs
3,744,544 A 7/1973 Wellensiek
3,756,585 A 9/1973 Mihalcheon
3,799,236 A 3/1974 Debs
3,817,309 A 6/1974 Takazawa
3,918,513 A 11/1975 Englund et al.
3,931,846 A 1/1976 Zilver
3,952,789 A 4/1976 Marotto
4,039,020 A 8/1977 Jacobson
4,157,108 A 6/1979 Donofrio
4,180,118 A 12/1979 Vecchiarelli
4,205,816 A 6/1980 Yu
4,223,714 A 9/1980 Weinreich et al.
4,245,688 A 1/1981 Vecchiarelli
4,250,597 A 2/1981 Ford et al.
4,326,577 A 4/1982 Tse
4,344,474 A 8/1982 Berman
4,352,386 A 10/1982 Butler et al.
4,398,585 A 8/1983 Marlow
4,476,909 A 10/1984 Anderle et al.
4,487,243 A 12/1984 Debs
4,488,588 A 12/1984 McClure
4,574,864 A 3/1986 Tse
4,610,292 A 9/1986 Hausmann et al.
4,623,012 A 11/1986 Rude et al.
4,625,786 A 12/1986 Carter et al.
4,631,217 A 12/1986 Anderson
4,647,488 A 3/1987 Schnebly et al.
4,649,982 A 3/1987 Baumann et al.
4,674,550 A 6/1987 Graves
4,722,383 A 2/1988 Kross
4,726,410 A 2/1988 Fresh
4,852,627 A 8/1989 Peterson et al.
4,856,574 A 8/1989 Minami et al.
4,862,941 A 9/1989 Colson
4,877,075 A 10/1989 Markowitz
4,880,045 A 11/1989 Stahler
4,884,618 A 12/1989 Steeves
4,886,102 A 12/1989 Debs
4,945,970 A 8/1990 Marocco
4,955,421 A 9/1990 Torti
4,982,776 A 1/1991 Kuhar et al.
4,984,617 A 1/1991 Corey
5,054,162 A 10/1991 Rogers
5,067,541 A 11/1991 Coslett
5,083,598 A 1/1992 Schon
5,103,888 A 4/1992 Nakamura
5,105,867 A 4/1992 Coslett
5,133,399 A 7/1992 Hiller et al.
5,141,041 A 8/1992 Katz et al.
5,143,135 A 9/1992 Kuhar
5,156,196 A 10/1992 Corey et al.
5,157,808 A 10/1992 Sterner, Jr.
5,170,830 A 12/1992 Coslett
5,184,660 A 2/1993 Jelic
5,228,491 A 7/1993 Rude et al.
5,274,357 A 12/1993 Riordan
5,313,998 A 5/1994 Colson et al.
5,318,090 A 6/1994 Chen
5,320,154 A 6/1994 Colson et al.
5,363,898 A 11/1994 Sprague
5,391,967 A 2/1995 Domel et al.
5,413,161 A 5/1995 Corazzinni
5,472,036 A 12/1995 Judkins
5,482,100 A 1/1996 Kuhar
5,482,105 A 1/1996 Rude
5,485,875 A 1/1996 Genova
5,531,257 A 7/1996 Kuhar
5,547,009 A 8/1996 Plumer
5,623,982 A 4/1997 Okazaki
5,671,793 A 9/1997 Lee
5,699,847 A 12/1997 Villette et al.
5,706,876 A 1/1998 Lysyj
5,799,715 A 9/1998 Biro et al.
5,853,040 A 12/1998 Benthin
5,855,235 A 1/1999 Colson et al.
6,012,506 A 1/2000 Wang et al.
6,024,154 A 2/2000 Wang et al.
6,029,734 A 2/2000 Wang et al.
6,032,716 A 3/2000 Mattey
6,047,759 A 4/2000 Lysyj
6,050,321 A 4/2000 Koks et al.
6,056,036 A 5/2000 Todd et al.
6,079,471 A 6/2000 Kuhar
6,112,800 A 9/2000 Marusak
6,129,131 A 10/2000 Colson
6,142,211 A 11/2000 Judkins
6,155,328 A 12/2000 Welfonder
6,158,563 A 12/2000 Welfonder et al.
6,223,802 B1 5/2001 Colson
6,283,192 B1 9/2001 Toti
6,330,899 B1 * 12/2001 Ciuca et al. ..... 160/170 R

* cited by examiner

FIG. 1
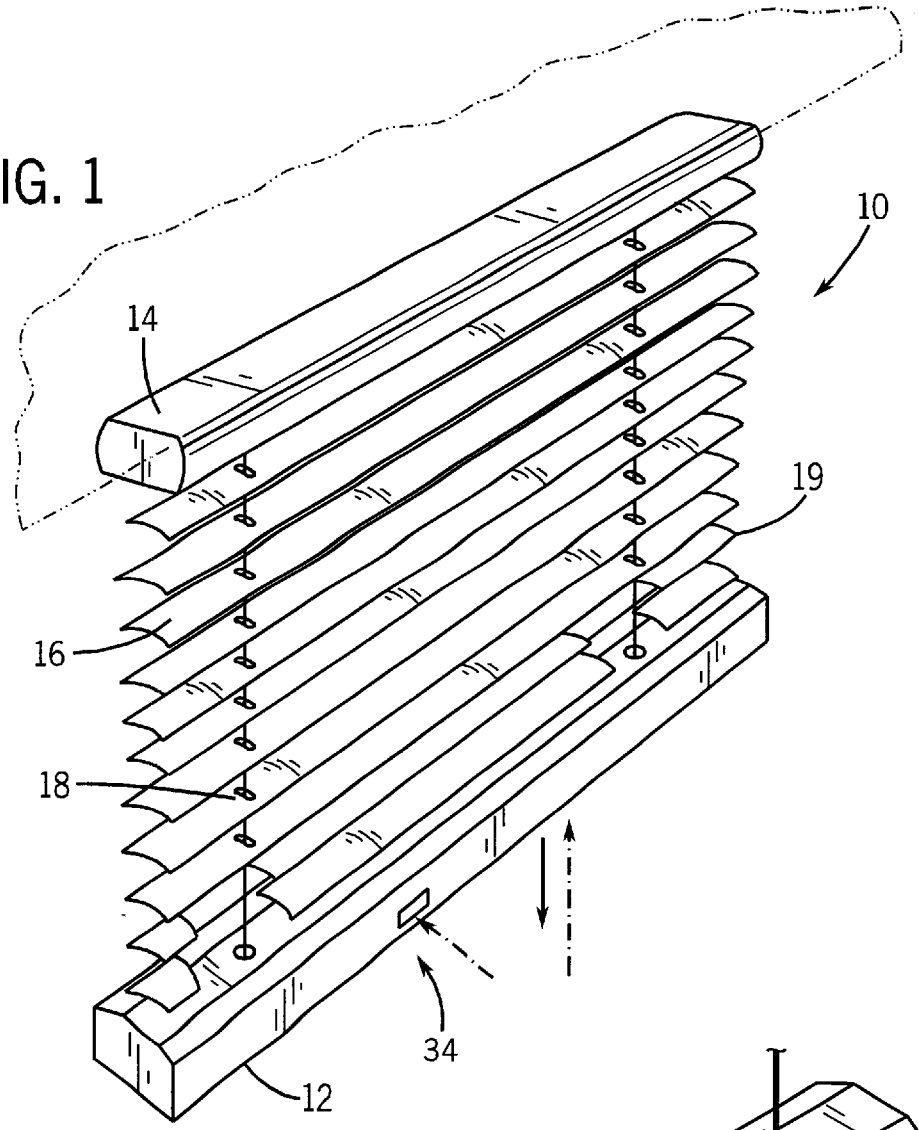
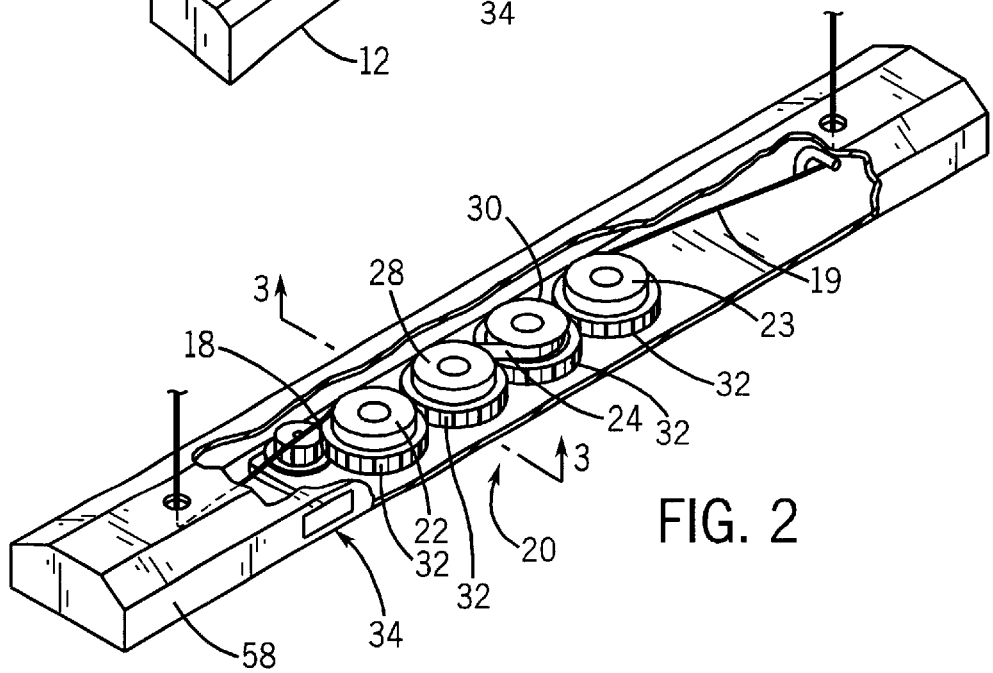
FIG. 2

FIG. 6
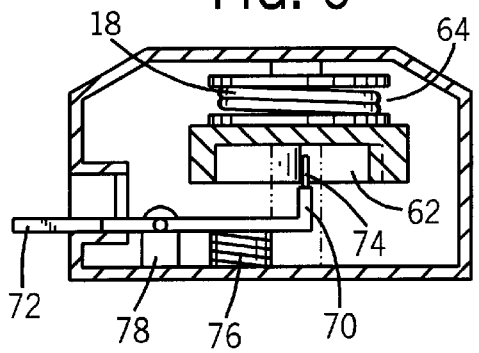
FIG. 7
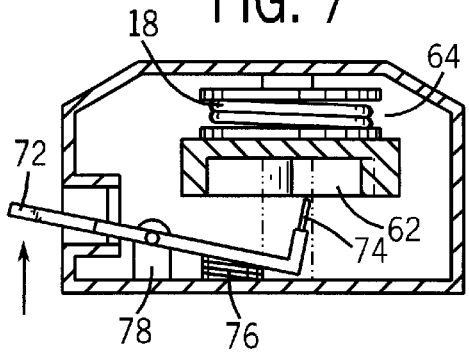
FIG. 8
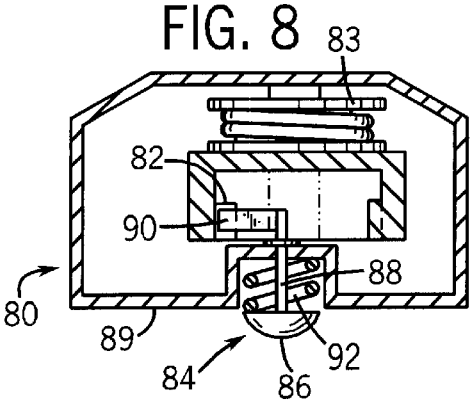
FIG. 9
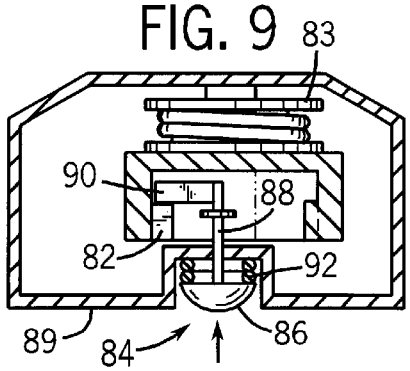
FIG. 10
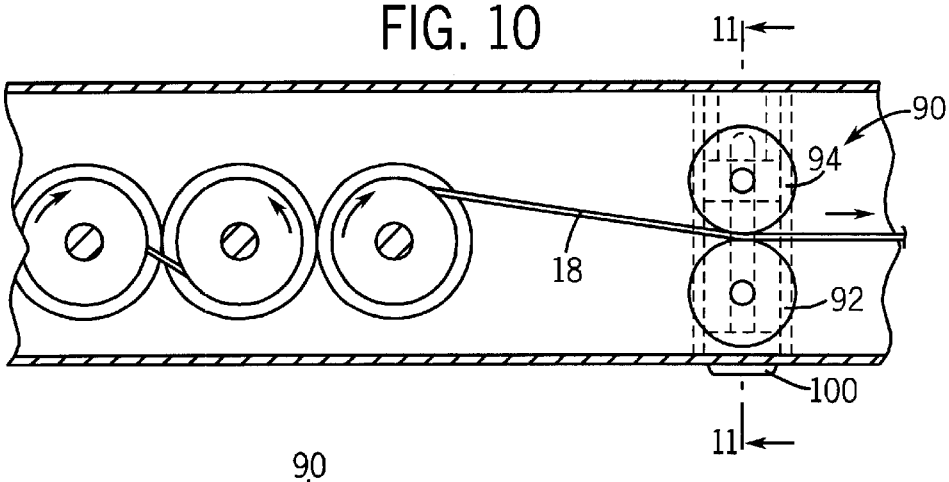
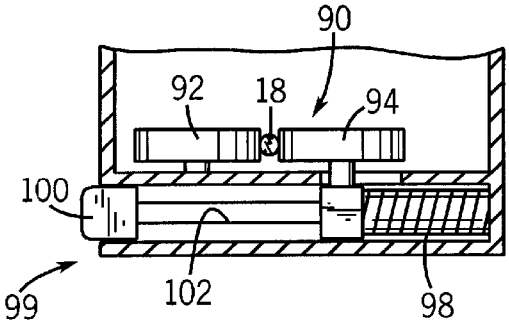
FIG. 11

FIG. 12
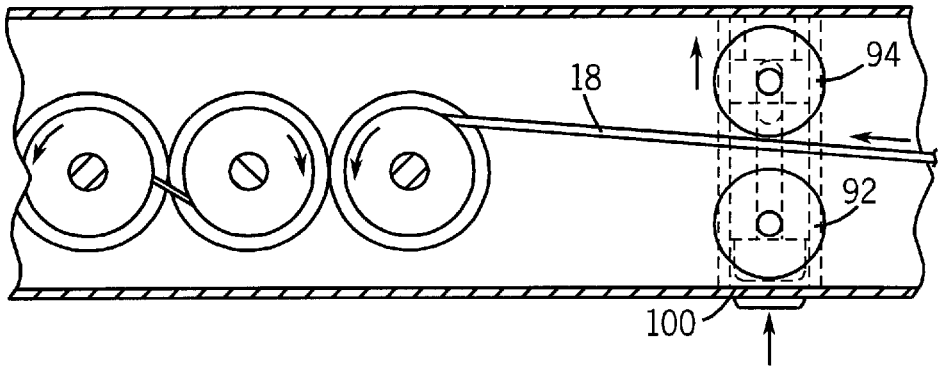
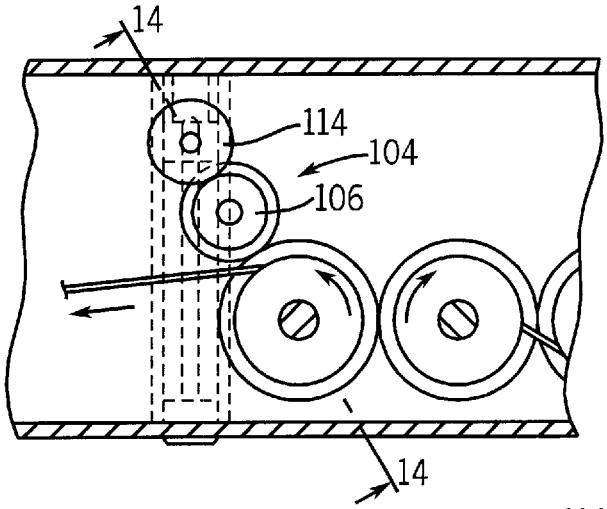
FIG. 13
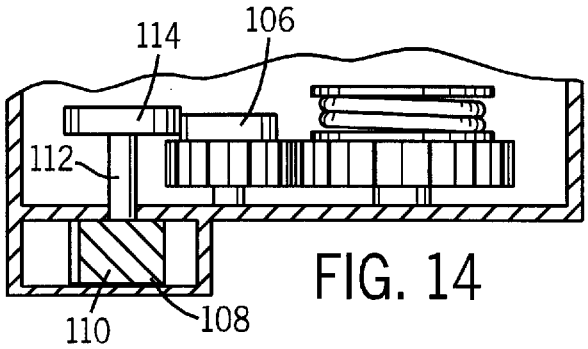
FIG. 14
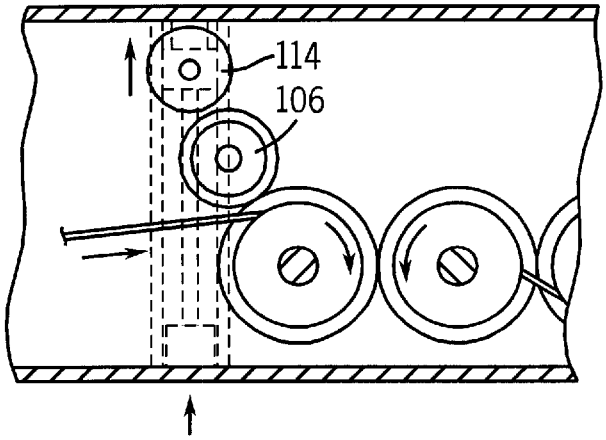
FIG. 15

CORDLESS BLIND BRAKE

FIELD OF THE INVENTION

The present invention relates generally to a cordless blind, and more particularly to a cordless blind having a one way brake.

BACKGROUND OF THE INVENTION

In a traditional venetian blind window covering, the slats are raised and lowered by a pair of lift cords. The lift cords are typically secured to a bottom rail and extend upward through the slats into a head rail. The lift cords are guided within the head rail and exit through a cord lock. The lift cords hang outside of the window covering, may present a safety concern to small children and pets. In order to raise or lower the window covering the lift cords must be manipulated to first release the cord lock. Similarly, once the window covering has been raised or lowered the cord lock must be manipulated again to lock the cords in place.

Blinds and shades in which the lift cords are contained within the bottom rail, window covering and head rail are referred to as cordless blinds and shades, since no portion of the lift cords are external to the blind or shade. Cordless blinds have been gaining popularity and are employed in a wide variety of blinds and shades such as Venetian blinds, cellular blinds, pleated shades, and wood blinds.

One type of cordless blind disclosed in U.S. Pat. Nos. 5,482,100; 5,531,257; and 6,079,471, and incorporated herein, utilizes a spring motor to apply a spring force to the lift cords to bias the bottom rail and accumulated window covering toward the top rail. In a balanced window blind system, the spring force of the spring motor, system frictional forces and the combined weight of the bottom rail and accumulated window covering are selected to balance the bottom rail relative to the top tail. In such systems the frictional force is greater than the difference between the spring force and the combined weight of the bottom rail and accumulated window covering when the bottom rail is at any location between a fully extended position and a fully retracted position.

If the system is not in balance as described above, the bottom bar will either move upward or downward depending on the imbalance in the system. For example if the spring force is greater than the weight of the bottom bar and accumulated window covering and the frictional forces in the system, then the bottom bar will continue to be biased upward toward the head rail, until the weight of the accumulated window covering balances the system. Similarly, if the spring force and frictional system forces are less than the weight of the bottom bar and accumulated window covering the bottom bar will move downward away from the head rail.

Since the weight of the accumulated window covering increases as the bottom bar moves toward the head rail, it is possible that the spring force causes the bottom bar to move toward the head rail when the bottom rail is fully extended, but when the bottom rail is close to the head rail, the weight of the bottom rail and accumulated window covering causes the bottom bar to move away from the head rail.

One type of cordless blind that employs a spring to bias the lift cords is described in U.S. Pat. No. 6,029,154 in which a brake is applied to the spring motor to prohibit the bottom member from moving toward or away from the head rail without the brake being released. Similarly, U.S. Pat. No. 6,029,734 discloses a bind having a spring motor in which a brake is applied directly to the lift cords within the bottom rail to prohibit the bottom member from moving toward or away from the head rail. This brake system allows the use of a cordless blind without the need to ensure that all of the forces are in balance. Since, neither of the blinds are balanced, the brake mechanisms disclosed in the '154 and '734 patents prevent the lift cords from either unwinding or retracting thereby preventing the bottom rail from moving either toward or away from the head rail until the brake is released.

There are a number of problems with this type of brake system. First, an operator must release a brake mechanism before raising or lowering the blind. Additionally, if an operator fails to release the brake mechanism before pulling the bottom bar downward, the brake mechanism may be damaged or the blind itself may be damaged.

Further, if the blind is raised to the full open position such that bottom rail is close to the top rail, it may be difficult for a user to disengage the lock at that height.

Accordingly, it would be desirable to provide a cordless blind having a brake mechanism that would permit the blind to be lowered without requiring the brake to be released. It would also be advantageous to provide a cordless blind having a brake mechanism in which the bind could be raised by manual biasing of the bottom rail toward the top rail without releasing the brake.

SUMMARY OF THE INVENTION

A window blind comprises a head rail, a bottom rail and a window covering extending between and operatively connected to the head rail and bottom rail. At least one lift cord extends between the bottom rail and the head rail. A spring motor operatively coupled to the lift cord biases the bottom rail toward the head rail. A one way brake prohibits the bottom rail from moving toward the head rail but permits the bottom rail to be moved away from the head rail by an operator.

In another embodiment a window blind comprises a head rail, a bottom rail, and a window covering extending between and operatively connected to the head rail and bottom rail. At least one lift cord extends between the bottom rail and the head rail. A spring motor is operatively coupled to the lift cord to apply an upward force on bottom rail toward the head rail. A one way brake in an engaged position prohibits the spring motor from moving the bottom rail in a first direction relative to the head rail and permits the bottom rail to be moved in a direction opposite to the first direction relative to the head rail. A switch is located in the bottom rail and is operatively connected to the one way brake to disengage the one way brake to permit movement of the bottom rail in the first direction.

In a further embodiment a window blind comprises a head rail and a bottom rail. A window covering extends between and is operatively connected to the head rail and bottom rail. At least one lift cord extends between the bottom rail and the head rail. A spring motor is operatively coupled to the lift cord to apply an upward force to the bottom rail toward the head rail. A one way brake prohibits the bottom rail from moving away from the head rail but permits the bottom rail to be moved toward the head rail by an operator.

BRIEF DESCRIPTION OF THE DRAWINGS

The invention will become more fully understood from the following detailed description, taken in conjunction with the accompanying drawings, wherein like reference numerals refer to like elements, in which:

FIG. 1 is a perspective view of a cordless blind;

FIG. 2 is a partial perspective view of the bottom rail with a portion broken away showing the one-way brake mechanism of the cordless blind.

FIG. 6 is a cross-sectional view of the one-way brake mechanism taken generally along lines 6—6 of FIG. 5.

FIG. 7 is a cross-sectional view of the one-way brake mechanism of FIG. 6 in the disengaged position.

FIG. 8 is a cross-sectional view of a third embodiment of a one-way brake mechanism in the engaged position.

FIG. 9 is a cross-sectional view of the third embodiment illustrated in FIG. 8 in the disengaged position.

FIG. 10 is a fourth embodiment of a one-way brake mechanism in the engaged position.

FIG. 11 is a cross sectional view of the fourth embodiment taken generally along lines 11—11 of FIG. 10.

FIG. 12 is a cross-sectional view of the fourth embodiment of the one-way brake mechanism in the disengaged position.

FIG. 13 is a fifth embodiment of a one-way brake mechanism in the engaged position.

FIG. 14 is a cross sectional view of the fifth embodiment taken generally along lines 14—14 of FIG. 13.

FIG. 15 is a cross-sectional view of the fifth embodiment of the one-way brake mechanism in the disengaged position.

DETAILED DESCRIPTION OF THE PREFERRED EMBODIMENTS

Figure 3:
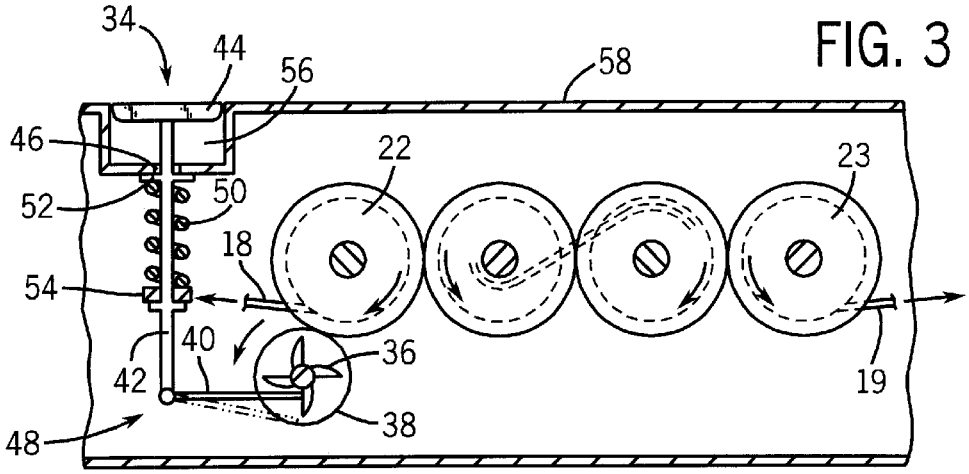
FIG. 3 is a cross-sectional view of the one-way brake mechanism in the engaged position taken generally along lines 3—3 of FIG. 2.

Referring to FIG. 1, a cordless blind 10 includes a bottom rail 12, a head rail 14 and a window covering 16 extending therebetween. A pair of lift cords 18, 19 extend between and operatively connect the bottom rail 12 and the head rail 14. Referring to FIG. 2, a spring motor 20 rotates a pair of cord spools 22, 23 to wind the lift cords 18, 19 thereby biasing the bottom rail 12 toward the head rail 14. In this way the window covering material is moved from a fully extended position in which the window is substantially covered to a fully raised position in which the window is substantially uncovered.

The window covering illustrated in FIG. 1 is a venetian blind having a plurality of slats supported by a pair of ladder cords. However, the window covering could be any type of blind or shade. For example, the window covering may also include a cellular shade, a roller shade, a Roman shade, a light control shade, pleated shade or any other blind or shade material known in the art.

Figure 4:
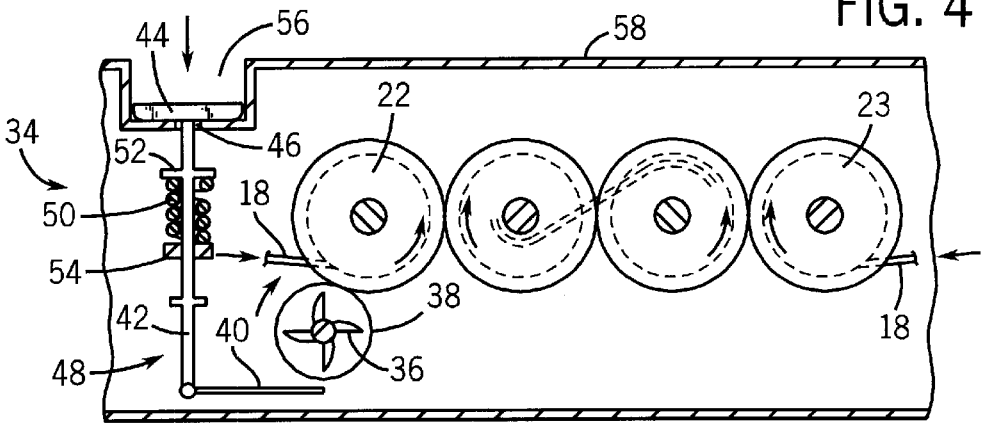
FIG. 4 is a cross-sectional view of the one-way brake mechanism illustrated in FIG. 3 in the disengaged position.

Referring to FIG. 2, spring motor 20 includes a spring 24 having a predetermined spring force. Spring 24 is coupled to a storage drum 28 for transfer to an output drum 30. In the preferred embodiment, the cord spools 22, 23 are operatively coupled to the storage drum 28 and output drum 30 with gears 32. Spring motor 20 through spring 24 acts to rotationally bias the cord spools 22, 23 to wind each lift cord 18, 19 about cord spools 22, 23 respectively. Referring to FIG. 4, cord spool 22 is biased to rotate counter-clockwise, and cord spool 23 is biased to rotate clockwise. The clockwise and counter-clockwise directions are illustrated with arrows in FIG. 4. Note that FIG. 4 is a view of the spring motor 20 from the bottom and the clockwise and counter-clockwise directions will be determined from this view.

Spring motor 20 could also be configured to bias cord spools 22, 23 to rotate clockwise and counter-clockwise respectively. The rotational direction of the cord spools aid in the explanation of the operation of the system. It is possible to alter the rotational direction of one or both of the cord spools 22, 23 by adding another gear between the cord spools and one or both of the storage and output drums 28, 30. It is also possible to change the way in which lift cords 18, and 19 are wound about cord spools 22, 23. In any event, the lift cords 18, 19 are attached to cord spools 22, 23 such that when the spring motor 20, biases the cord spools 22, 23, lift cords 18, 19 are wound about the respective cord spools 22, 23.

Referring to FIG. 3 a brake mechanism 34 operatively engages the cord spool 22 to selectively prohibit the cord spool 22 from rotating counter-clockwise thereby prohibiting lift cords 18, 19 from being wound about cord spools 22, 23. As a result the brake mechanism 34 prohibits the bottom bar from moving toward the head rail. Brake mechanism 34 includes a ratchet wheel 36 operatively engaged with the spring motor 20 with an auxiliary gear 38. Since, cord spool 22, cord spool 23, storage drum and output drums 28, 30 are operatively connected to one another with gears 32, a braking force applied to any member will have the effect of prohibiting rotation of the cord spools 22, 23.

Brake Mechanism 34 further includes a pawl 40 secured to a lever 42. A button 44 is attached to lever 42 and extends through an aperture 46 in bottom rail 12. In the embodiment illustrated in FIG. 1, button 44, lever 42 and pawl 40 make up a single activation unit 48. A brake spring 50 biases the activation unit 48 such that pawl 40 is engaged with ratchet wheel 36. Brake spring 50 is located between a first cross bar or barb 52 on lever 42 and a ledge 54 fixed relative to bottom rail 12. As illustrated in FIG. 3 brake spring 50 biases the activation unit 48, such that button 44, and lever 42 extend outwardly thereby engaging pawl 40 with ratchet wheel 36.

When the activation unit 48 is engaged, pawl 40 does not permit ratchet wheel 36 to rotate in a clockwise direction, thereby preventing cord spool 22 from rotating counter-clockwise and winding lift cords 18, 19 about cord spools 22, 23 as discussed above. As a result lift cords 18, 19 will not be wound about cord spools 22, 23 and consequently bottom rail 12 will not be raised toward head rail 14 until button 44 is pushed against the brake spring 50 releasing the pawl 40 from the ratchet wheel 36. A recess 56 is formed in a front side 58 of bottom rail 12 to accommodate button 44 as it is depressed to disengage pawl 40. In the preferred embodiment button 44 is flush with front side 58 of bottom rail 12, when the activation unit 48 is in the engaged position.

As discussed above, when activation unit 48 is engaged, the lift cords 18, 19 will not be wound about cord spools 22, 23, however, it is possible to unwind the lift cords 18, 19 from cord spools 22, 23 by simply pulling down on the bottom rail. The pawl 40 prevents the cord spool 22 from winding cord 18 but it does not prevent the cord spool 23 from rotating clockwise, thereby allowing the lift cords 18, 19 to unwind about.

As illustrated in FIG. 4 the activation unit 48 is in a disengaged position when button 44 is depressed thereby extending pawl 40 away from ratchet wheel 36. When ratchet wheel 36 is free to rotate clockwise, cord spool 22 is free to rotate counter-clockwise and as a result lift cords 18, 19 are wound about cord spools 22, 23 respectively. This then permits the spring motor 20 to bias the bottom rail 12 toward the head rail 14.

Figure 5:
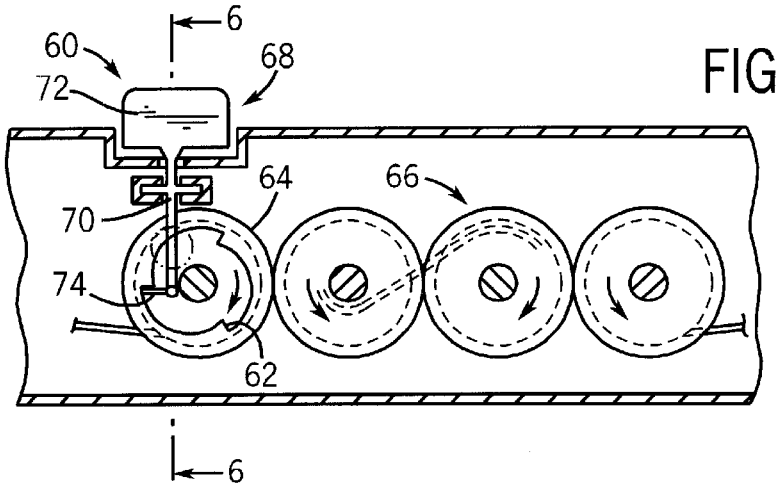
FIG. 5 is a cross-sectional view of an alternative embodiment of the one way lock mechanism.

Referring to FIGS. 5–7, another embodiment of a one-way brake mechanism 60 includes an internal ratchet 62 that is integral with a cord spool 64 of a spring motor 66. Since the components of the cordless blind 10 for the embodiment illustrated in FIGS. 1–4 are the same for the embodiment illustrated in FIGS. 5–7, the same reference numerals will be used to identify the similar components. Where the components are different a different reference numeral will be used to designate different components. For example the head rail, window covering and lift cords are the same for each of the embodiments, however, the spring motor, and cord spools used for different embodiments will be designated with different reference numerals.

Brake mechanism 60 includes an activation unit 68 having a lever 70 provided with free end 72 in the form of a flat plate. A pawl 74 extends upward from a second end of lever 70. A brake spring 76 biases pawl 74 into engagement with internal ratchet 62. As illustrated in FIG. 6, lever 70 pivots about a fulcrum 78, such that an upward movement of the free end 72 of lever 70 results in a downward movement of pawl 74 from internal ratchet 62, thereby disengaging the pawl 74 from the internal ratchet 62. When pawl 74 is engaged with internal ratchet 62, the cord spool is permitted to rotate in a single direction. As illustrated in FIG. 5 cord spool 64 is permitted to rotate clockwise but not counter-clockwise when the pawl 74 is engaged, thereby prohibiting lift cord 18 from being wound about cord spool 64, but permitting lift cord 18 to be unwound from cord spool 64.

As shown is FIG. 7, when the free end 72 of lever 70 is moved upward, pawl 74 is disengaged from internal ratchet 62 thereby permitting the lift cords to be wound about the cord spools resulting in the lifting of the bottom rail toward the head rail. The upward movement of the lever 70 provides an intuitive motion of a user to move the bottom rail in the upward direction, since the force of the user against the button is the same direction as the bottom rail toward the head rail. Since the user would be pressing the lever 70 in the upward direction, the force of the operator against the lever 70 and bottom rail would assist the movement of the bottom rail in the upward direction.

Another one-way brake mechanism 80 employing an internal ratchet 82 attached to or integral with a cord spool 83 is illustrated in FIGS. 8 and 9. In this embodiment an activation unit 84 includes a button 86 attached to a lever 88 extending upward from the bottom or underside 89 of the bottom rail. A pawl 90 extends from the end of lever 88 and interacts with internal ratchet 82. A brake spring 92 biases the activation unit 84 downward thereby biasing the pawl 90 into engagement with the internal ratchet 82. In this engaged position, the spring motor is stopped from winding the lift cords about the cord spool 83. However, since the ratchet/pawl arrangement allows the rotation of the cord spool 83 in a single direction, it is possible to lower the bottom rail by simply pulling the bottom rail downward. The one-way brake 80 permits the cord spool to rotate in a direction such that the lift cord is unwound therefrom. This permits the bottom rail to extend in away from the head rail. However, upon release of the bottom rail by the user, the cord spool is stopped from winding the lift cord by the ratchet/pawl mechanism.

The brake 80 is disengaged by pressing the button 86 upward into the bottom rail thereby releasing the pawl 90 from the ratchet 82. Once the pawl 90 has been disengaged, the cord spool 83 is free to rotate and wind the lift cord thereby biasing the bottom rail 12 toward the head rail 14. As in the last embodiment, the depression of the button 86 upward would also intuitively correspond with an operator's expectation that the bottom rail 12 should move upwards.

While the internal ratchets 62, 82 of the brake mechanisms 60 and 80 are attached to cord spools 64, 83 respectively, the internal ratchets 62, 82 could also be integral with one of the storage or output drums of the spring motor.

The embodiments illustrated in FIGS. 1–9 apply the one-way positive braking mechanism to the spring motor and cord spools 22 either directly or through an auxiliary gear. Without releasing the pawl from the ratchet wheel it is not possible to wind the lift cords about the cord spools. In these embodiments movement of the bottom rail in a downward direction away from the head rail simply requires the operator to exert a downward force sufficient to over come any system frictional forces (Ffd) resisting downward movement and the difference between the Spring motor force (SMf) and the weight of the bottom rail (Rw) and the weight of the accumulated window covering (WCw). The force required by the operator (Of) to move the bottom rail downward can be expressed as Of>(SMf+Ffd)−(Rw+WCw).

In an alternative embodiment illustrated in FIGS. 10–12, a frictional force is applied to at least one of the lift cords 18 with a roller mechanism 90. Roller mechanism 90 includes a first stationary roller 92 and a second movable roller 94. The movable roller 94 is spring biased against the stationary roller 96 with a roller spring 98. Lift cord 18 passes between the first and second rollers 92, 94. The frictional force acting upon the lift cords 18 is greater than the spring force of the spring motor biasing the lift cord onto the cord spools. As a result, the bottom rail will not move toward head rail until the frictional force of the roller mechanism 90 is reduced.

As illustrated in FIG. 11, a release mechanism 99 includes a button 100 and a lever 102 attached to the movable roller 94. When an operator depresses button 100, the force of roller spring 98 is overcome and the movable roller 94 moves away from the stationary roller 92 thereby releasing the frictional force on the lift cord. As a result the lift cord is free to move relative to the first and second rollers thereby permitting the lift cords to be wound about the cord spools.

However, a user could apply additional downward force onto the bottom rail thereby overcoming the additional frictional force of the rollers 92, 94. As a result an operator would be able to lower the bottom rail without releasing the frictional brake mechanism 90.

Similarly, as illustrated in FIGS. 13–15 a frictional one-way brake 104 may be applied to one of the components on the spring motor or to an auxiliary gear 106. A release mechanism 108 would be similar to the embodiments discussed above, with an external button 110 and lever 112 to move a spring biased element or roller 114 away from the spring motor. Here the friction is not applied to the lift cords, but rather directly to the spring motor itself.

The benefit of the frictional brakes is the reduction in complexity and the elimination of the pawl and ratchet member which will not operate properly if the pawl member is damaged or one of the ratchet teeth on the ratchet wheel is damaged. Additionally, the use of a ratchet provides for a discrete number of positions based upon the number of teeth on the ratchet wheel. In contrast, the frictional device provides for a continuous positioning of the bottom rail, thereby allowing for more precise location of the bottom rail.

All of the embodiments described above utilize the one-way brake mechanisms to prohibit the spring motor from moving the bottom rail toward the head rail without first disengaging the brake. However, all of the embodiments do permit a user to pull the bottom rail downward away from the head rail without releasing the brake. This concept may be referred to as the upward one-way brake, in that the bottom rail 12 may not move upward until the brake is released. The embodiments that utilize a ratchet/pawl arrangement permit the bottom rail to move downward, therefore the combined weight of the bottom rail (Rw) and the accumulated window covering (WCw) must be less than the forces resisting downward movement including the system friction (Ffd) resisting downward movement and the spring force of the spring motor (SMf). This ensures that the bottom rail does not move downward without additional force. This can be expressed as (Rw+WCw)<(SMf+Ffd). The System friction (Ff) tends to oppose movement in both directions, although not necessarily with the same force, depending on the source of the system friction. Accordingly, system friction that opposes downward movement of the bottom rail will be designated Ffd and system friction that opposes upward movement of the bottom rail will be designated Ffu.

In this system, for the bottom rail to be urged upward when the brake is released the spring force must be greater than the forces resisting upward movement of the bottom rail: SMf>Ffu+(Rw+WCw).

The upward one-way brake embodiments that utilize a friction device either applied to the cord or to one of the members of the spring motor, operate by ensuring that the frictional force applied to the system by the one-way brake (Bf) is greater than the spring force of the spring motor (SMf) minus the combined weight of the bottom rail (Rw) and the weight of accumulated window covering (WCw) and the system friction (Ffu) opposing upward motion of the bottom rail. This can be expressed as Bf>SMf−(Ffu+Rw+WCw). This relationship is required in addition to that stated above for the upward one-way brake utilizing the ratchet that SMf>Ffu+(Rw+WCw).

These two relationships ensure that the frictional force (Bf) applied by the one-way brake will be sufficient to prohibit the bottom rail from moving downward and away from the head rail without additional force, and yet is sufficient to prohibit the lift cords from rewinding thereby causing the bottom rail to move upward without releasing the brake.

The one-way brake mechanisms may be modified such that the brake mechanisms prohibit the bottom rail from moving downward away from the head rail unless the brake is disengaged, but allow a user to move the bottom rail toward the head rail by simply pushing the bottom rail in an upward direction. This embodiment will be referred to as the downward brake, in that the bottom rail may not move downward until the brake is released. The mechanisms utilizing a ratchet/pawl arrangement are set such that the brake permits the cord spools to wind the lift cords thereabout to bias the bottom rail toward the head rail, but prohibits the lift cords from unwinding from the cord spools to prevent the bottom rail from moving away from the head rail.

In bottom one-way brake mechanisms, the combined weight of the bottom rail (Rw) and the weight of the accumulated window covering (WCw) is greater than the spring force of the spring motor (SMf) and the system friction (Ffd) opposing downward movement of the bottom rail. This can be expressed as (Rw+WCw)>(SMf+Ffd). Given this distribution of forces, the spring motor does not exert sufficient force to bias the bottom rail toward the head rail without additional force.

When a user manually raises the bottom rail, the spring force of the spring motor is sufficient to wind the lift cords about the cord spools. The force required by the user (Of) to raise the bottom rail such that the spring motor force will wind the lift cords must be greater than the difference between the Spring Motor force (SMf) and the combined weights of the bottom rail (Rw) and accumulated window covering (WCw) and the system friction (Ff) opposing upward movement of the bottom rail: Of>[(SMf)−(Rw+WCw+Ffu)].

If a friction brake mechanism is employed for a downward brake, the brake force (Bf) must be sufficient to prevent the blind from moving downward: Bf>(Rw+WCw)−(SMf+Ffd).

For all of the downward brake embodiments, once the user stops raising the bottom rail the bottom rail will stay in place since the spring force is not sufficient to lift the weight of the bottom rail and accumulated window covering as noted above.

As discussed above for the upward one-way brake mechanisms it is desirable for the lever or actuating button to release the upward one-way brake be moved in an upward direction, that would be intuitive for a user. Similarly, the release lever or actuating button for the downward one-way brake may be designed such that the lever or actuating button are being pushed downward. This would correspond with a users intuitive sense that to move the blind downward the lever or button should be pushed downward. Accordingly, the button could be located on a top surface of the bottom rail, such that release of the downward one-way brake would be accomplished by pressing the button downwards. Similarly, the lever could be designed such that the bottom one-way brake can be released by movement of the lever in a downward direction. For example referring to FIGS. 6 and 7, the entire mechanism could be inverted such that downward movement of the lever would release the pawl from the ratchet.

If a window covering is a set size, the spring force, system frictional forces, and may be designed into the window blind, to ensure that the one-way brake mechanism will operate over the entire operation of the blind. That is when the blind is fully extended, fully retracted and any position in between. However, many window sizes are not standard, and are sized at the point of purchase or on an individual basis by a manufacturer. Once, the window covering has been sized to a customer's specification to fit the geometry of a given window the weight of the bottom rail and window covering is set.

In order to ensure that the one-way brake mechanism will work the system will have to be balanced such that the equations outlined above for the various systems will be appropriate. The factors that can be varied once the window covering size is set, is the spring motor force, the system friction (utilizing a variable friction mechanism), the brake friction (if utilizing the one-way friction brake embodiments), and the weight of the bottom rail, by adding additional weight to or removing weight from the bottom rail. The spring force can be varied by utilizing a spring motor having a greater or lesser spring force as required, or by adding or removing spring motor modules to achieve the required spring force. Any one of these forces can be varied to enable the manufacturer to set the force equations such that the one-way brake mechanism will operate at all positions of the bottom rail relative to the head rail.

It is also contemplated that the spring force may be constant for all positions of the bottom rail relative to the head rail or the spring force may vary as a function of the position of the bottom rail relative to he head rail. It is recognized that it is possible to design a system in which the spring force, system frictional forces vary as the bottom rail is moved from a fully lowered position in which the bottom rail is furthest from the head rail to a fully raised position in which the bottom rail is closest to the head rail, this may be desirable since the weight of the window covering that accumulates on the bottom rail as the bottom rail moves toward the head rail increases. For the one-way brake mechanism to function properly such that the bottom rail does not move toward or away from the head rail unintentionally the force equations outlined above need to be achieved for all positions of the bottom rail relative to the head rail. Where it is contemplated that the bottom rail will never be fully raised or fully lowered, the force equations outlined above, need not be achieved for these positions of the bottom rail.

While the detailed drawings, specific examples and particular formulations given describe exemplary embodiments, they serve the purpose of illustration only. The brake systems shown and described may differ depending on the chosen performance characteristics and physical characteristics of the blinds. The systems shown and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A window blind comprising:

a head rail;

a bottom rail;

a window covering extending between and operatively connected to the head rail and bottom rail;

a lift cord extending between the bottom rail and the head rail;

a cord spool rotatably mounted in one of the head rail and the bottom rail, an end of the lift cord proximate the one of the head rail and the bottom rail being coupled to the cord spool;

a spring motor operatively coupled to the cord spool, the spring motor being adapted to rotate the cord spool to wind the lift cord thereon when the bottom rail moves toward the top rail, wherein the spring motor biases the bottom rail toward the head rail; and a one way brake engaging a moving component of the window blind, wherein friction of the one way brake prevents rotation of the cord spool when the bottom rail is moved toward the head rail, and permits rotation of the cord spool when the bottom rail is moved away from the head rail.

2. The apparatus of claim 1, wherein there are at least a pair of lift cords.

3. The apparatus of claim 2, wherein the spring motor is located in the bottom rail and includes a spring operatively connected to a cord spool.

4. The apparatus of claim 3, wherein the one way brake is located in the bottom rail.

5. The apparatus of claim 4, wherein, the one way brake includes a frictional member applied to the cord.

6. The apparatus of claim 5, wherein the one way brake includes a frictional roller operatively applied to the spring motor.

7. The apparatus of claim 6, wherein the ratchet frictional member includes a lever operatively connected thereto, wherein upward movement of the lever by a user releases the frictional member from the spring motor.

8. The apparatus of claim 1, wherein the spring has a predetermined spring force, the bottom rail having a predetermined weight, and the window covering having a predetermined weight, the spring force being greater than the combined weight of the bottom rail, and the window covering.

9. The apparatus of claim 1, wherein the window covering includes one of a plurality of slats, cellular shade, pleated shade, light-control shade, and Roman shade.

10. The window blind of claim 1, wherein the moving component is selected from the group comprising the lift cord, the cord spool and the spring motor.

11. The window blind of claim 1, wherein the one way brake engages cord spool.

12. The window blind of claim 1, wherein the one way brake engages the spring motor.

13. The window blind of claim 1, wherein the moving component of the window blind includes a plurality of first gear teeth, and the one way brake comprises a gear having a plurality of second gear teeth meshing with the first gear teeth, and a roller being biased into engagement with the gear, wherein friction acting on the roller and the gear prevents rotation of the cord spool when the bottom rail is moved toward the head rail.

14. The window blind of claim 13, wherein the one way brake further comprises a release mechanism being adapted to move the roller between an engaged position wherein the roller engages the gear to prevent rotation of the cord spool when the bottom rail is moved toward the head rail, and a disengaged position wherein the roller does not engage the gear such that the one way brake prevents rotation of the cord spool when the bottom rail is moved toward the head rail.

15. A window blind comprising:

a head rail;

a bottom rail;

a window covering extending between and operatively connected to the head rail and bottom rail;

a lift cord extending between the bottom rail and the head rail;

a cord spool rotatably mounted in one of the head rail and the bottom rail, an end of the lift cord proximate the one of the head rail and the bottom rail being coupled to the cord spool;

a spring motor operatively coupled to the cord spool, the spring motor being adapted to rotate the cord spool to wind the lift cord thereon when the bottom rail moves toward the top rail, wherein the spring motor biases the bottom rail toward the head rail; and a releasable one way brake engaging a moving component of the window blind, wherein friction of the one way brake prevents rotation of the cord spool when the bottom rail is moved in a first direction relative to the head rail, and permits rotation of the cord spool when the bottom rail is moved in a second direction relative to the head rail.

16. The window blind of claim 15, wherein the first direction is toward the head rail.

17. The window blind of claim 15, wherein the first direction is away from the head rail.

18. The window blind of claim 15, wherein the one way brake includes means for applying friction to the lift cord.

19. The window blind of claim 18, wherein the means for applying friction to the lift cord includes a pair of rollers biased toward one another and receiving a portion of the lift cord there between.

20. The window blind of claim 18, wherein the means for applying friction to the lift cord includes a member biased against a second member operatively connected to the spring motor.

21. The window blind of claim 15, wherein the releasable one way brake is moveable between an engaged position wherein friction of the one way brake prevents rotation of the cord spool when the bottom rail is moved in the first direction, and a disengaged position wherein friction of the one way brake permits rotation of the cord spool when the bottom rail is moved in the first direction.

22. The window blind of claim 15, wherein the moving component is selected from the group comprising the lift cord, the cord spool and the spring motor.

23. The window blind of claim 15, further comprising a release mechanism being adapted to move the releasable one way brake between the engaged position and the disengaged position.

24. The window blind of claim 23, wherein the release mechanism has an operating portion movable by an operator to move the releasable one way brake to the disengaged position.

25. The window blind of claim 15, wherein the one way brake engages the cord spool.

26. The window blind of claim 15, wherein the one way brake engages the spring motor.

27. The window blind of claim 15, wherein the moving component of the window blind includes a plurality of first gear teeth, and the releasable one way brake comprises a gear having a plurality of second gear teeth meshing with the first gear teeth, and a roller being biased into engagement with the gear, wherein friction acting on the roller and the gear prevents rotation of the cord spool when the bottom rail is moved in the first direction.

28. The window blind of claim 27, wherein the one way brake further comprises a release mechanism being adapted to move the roller between an engaged position wherein the roller engages the gear to prevent rotation of the cord spool when the bottom rail is moved in the first direction, and a disengaged position wherein the roller does not engage the gear such that the one way brake prevents rotation of the cord spool when the bottom rail is moved in the first direction.

29. A window blind comprising:

a head rail;

a bottom rail;

a window covering extending between and operatively connected to the head rail and bottom rail;

a lift cord extending between the bottom rail and the head rail;

a cord spool rotatably mounted in one of the head rail and the bottom rail, an end of the lift cord proximate the one of the head raid and the bottom rail being coupled to the cord spool;

a spring motor operatively coupled to the cord spool, the spring motor being adapted to rotate the cord spool to wind the lift cord thereon when the bottom rail moves toward the top rail, wherein the spring motor biases the bottom rail toward the head rail; and a one way brake engaging a moving component of the window blind, wherein friction of the one way brake prevents rotation of the cord spool when the bottom rail is moved away from the head rail, and permits rotation of the cord spool when the bottom rail is moved toward the head rail.

30. The apparatus of claim 29, wherein there are two lift cords.

31. The apparatus of claim 29, wherein the spring motor is located in the bottom rail and includes a spring operatively connected to a cord spool.re are two lift cords.

32. The apparatus of claim 31, wherein the one way brake is located in the bottom rail.

33. The apparatus of claim 29, wherein the one way brake includes a frictional member applied to the cord.

34. The apparatus of claim 33, wherein the one way brake includes a frictional roller operatively applied to the spring motor.

35. The apparatus of claim 33, wherein the frictional member includes a lever extending therefrom, wherein downward movement of the lever by a user releases the frictional member from the spring motor.

36. The apparatus of claim 29, wherein the spring has a predetermined spring force, the bottom rail having a predetermined weight, and the window covering having a predetermined weight, the spring force being less than the combined weight of the bottom rail, and the window covering.

37. The apparatus of claim 29, wherein the window covering includes one of a plurality of slats, cellular shade, pleated shade, light-control shade, and Roman shade.

38. The window blind of claim 29, wherein the moving component is selected from the group comprising the lift cord, the cord spool and the spring motor.

39. The window blind of claim 29, wherein the one way brake engages the cord spool.

40. The window blind of claim 29, wherein the one way brake spring motor.

41. The window blind of claim 29, wherein the moving component of the window blind includes a plurality of first gear teeth, and the one way brake comprises a gear having a plurality of second gear teeth meshing with the first gear teeth, and a roller being biased into engagement with the gear, wherein friction acting on the roller and the gear prevents rotation of the cord spool when the bottom rail is moved away from the head rail.

42. The window blind of claim 41 wherein the one way brake further comprises a release mechanism being adapted to move the roller between an engaged position wherein the roller engages the gear to prevent rotation of the cord spool when the bottom rail is moved away from the head rail, and a disengaged position wherein the roller does not engage the gear such that the one way brake prevents rotation of the cord spool when the bottom rail is moved away from the head rail.

* * * * *

UNITED STATES PATENT AND TRADEMARK OFFICE

CERTIFICATE OF CORRECTION

PATENT NO. : 6,644,375 B2
DATED : November 11, 2003
INVENTOR(S) : Roger C. Palmer It is certified that error appears in the above-identified patent and that said Letters Patent is hereby corrected as shown below:

Column 10,
Line 21, please delete “engages cord spool” and insert -- engages the cord spool --.

Column 11,
Line 60, please delete “of the head raid” and insert -- of the head rail --.

Column 12,
Line 16, please delete “to a cord spool.re are two lift cords” and insert -- to a cord spool --.
Line 42, please delete “brake spring motor” and insert -- brake engages the spring motor --.

Signed and Sealed this

Thirty-first Day of August, 2004

JON W. DUDAS
*Director of the United States Patent and Trademark Office*